US011357383B2

(12) United States Patent
Shin et al.

(10) Patent No.: US 11,357,383 B2
(45) Date of Patent: Jun. 14, 2022

(54) DISHWASHER

(71) Applicant: LG Electronics Inc., Seoul (KR)

(72) Inventors: Gapsu Shin, Seoul (KR); Pilsu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/968,469

(22) PCT Filed: Feb. 8, 2019

(86) PCT No.: PCT/KR2019/001572
§ 371 (c)(1),
(2) Date: Aug. 7, 2020

(87) PCT Pub. No.: WO2019/156504
PCT Pub. Date: Aug. 15, 2019

(65) Prior Publication Data

US 2020/0397214 A1 Dec. 24, 2020

(30) Foreign Application Priority Data

Feb. 8, 2018 (KR) ..... 10-2018-0015779

(51) Int. Cl.
*A47L 15/42* (2006.01)

(52) U.S. Cl.
CPC ..... *A47L 15/4214* (2013.01); *A47L 15/4217* (2013.01); *A47L 15/4221* (2013.01);
(Continued)

(58) Field of Classification Search
None
See application file for complete search history.

(56) References Cited

U.S. PATENT DOCUMENTS

2007/0251555 A1 11/2007 Choi et al.
2012/0055518 A1* 3/2012 Kim ..... A47L 15/4204 134/105
2016/0324396 A1 11/2016 Hong et al.

FOREIGN PATENT DOCUMENTS

JP 2007105210 4/2007
KR 20100048467 5/2010
(Continued)

OTHER PUBLICATIONS

Extended European Search Report in European Appln. No. 19751093.6, dated Sep. 19, 2021, 7 pages.
(Continued)

*Primary Examiner* — Levon J Shahinian
(74) *Attorney, Agent, or Firm* — Fish & Richardson P.C.

(57) ABSTRACT

A dishwasher includes a case, injection arms, a sump including an injection flow path coupling portion, a washing pump for supplying washing water stored in the sump to the injection arms, and a switching valve including a flow path distributor for distributing washing water to injection arms. The flow path distributor defines distribution holes. When the flow path distributor is in a reference position, the distribution holes are positioned so that all of the injection arm supply holes are opened, and, when the flow path distributor is rotated by a first angle from a reference position, the distribution holes are positioned so that any one of the injection arm supply holes is opened. The injection flow path coupling portion includes a plurality of support ribs protruded toward the flow path distributor and including a support rib corresponding to at least one of the distribution holes.

16 Claims, 14 Drawing Sheets

(52) U.S. Cl.
CPC ..... *A47L 15/4225* (2013.01); *A47L 15/4246* (2013.01); *A47L 15/4278* (2013.01); *A47L 2501/01* (2013.01); *A47L 2501/02* (2013.01); *A47L 2501/20* (2013.01)

(56) References Cited

FOREIGN PATENT DOCUMENTS

| | | |
|---|---|---|
| KR | 20120022426 | 3/2012 |
| KR | 2012013 8022 | 12/2012 |
| KR | 20130070275 | 6/2013 |
| KR | 101308375 | 9/2013 |

OTHER PUBLICATIONS

International Search Report in international Appln. No. PCT/KR2019/001572, dated Jun. 3, 2019, 5 pages (with English translation).

* cited by examiner

DISHWASHER

CROSS-REFERENCE TO RELATED APPLICATIONS

This application is a National Stage application under 35 U.S.C. § 371 of International Application No. PCT/KR2019/001572, filed on Feb. 8, 2019, which claims the benefit of Korean Application No. 10-2018-0015779, filed on Feb. 8, 2018. The disclosures of the prior applications are incorporated by reference in their entirety.

TECHNICAL FIELD

The present invention relates to a dishwasher including a switching valve for distributing washing water to at least one of a plurality of injection arms.

BACKGROUND ART

A dishwasher is a household appliance for washing dirt such as food waste on dishes or cooking utensils (hereinafter, referred to as a 'washing target') by washing water of a high pressure injected from an injection arm.

The dishwasher is generally configured with a tub for forming a washing chamber and a sump mounted in the bottom of the tub to store washing water. The washing water is moved to an injection arm by a pumping action of a washing pump mounted inside the sump, and the washing water moved to the injection arm is injected at a high pressure through an injection port formed in the injection arm. The washing water injected at a high pressure hits a surface of the washing target, and dirt on the washing target falls to the bottom of the tub.

A recent dishwasher includes a plurality of injection arms, and washing water is selectively injected from the plurality of injection arms according to an injection mode. In this case, a valve for adjusting the washing water transferred to the plurality of injection arms is provided.

In this case, the washing water is pressurized with a high pressure by the washing pump and is transferred to the injection arm through a switching valve along a washing water flow path, and there was a problem in that a back pressure was applied to the switching valve by a sub-flow of washing water inside the switching valve and that a vibration of the switching valve was generated.

In addition, there was a need to improve a noise caused by the vibration of the switching valve, which caused inconvenience to the user and the like.

DISCLOSURE

Technical Problem

The problem to be solved by the present invention is to reduce a vibration generated in a switching valve during an operation of a dishwasher.

Another problem to be solved by the present invention is to reduce a noise generated during an operation of a dishwasher.

Another problem to be solved by the present invention is to shorten the time taken to change an injection mode during an operation of a dishwasher.

The problems of the present invention are not limited to the problems mentioned above, and other problems that are not mentioned will be clearly understood by those skilled in the art from the following description.

Technical Solution

In order to achieve the above object, a dishwasher according to an embodiment of the present invention includes a case for receiving a washing object; a plurality of injection arms for injecting washing water into the case; a sump disposed at a lower side of the case to store the washing water and including an injection flow path coupling portion in which a plurality of injection arm supply holes communicating with the plurality of injection arms are respectively formed; a washing pump for supplying the washing water stored in the sump to the plurality of injection arms through the injection flow path coupling portion; and a switching valve disposed in the injection flow path coupling portion and including a flow path distributor for distributing washing water to at least one of the plurality of injection arms.

The injection flow path coupling portion may be provided with a plurality of support ribs protruded toward the flow path distributor.

The flow path distributor may have a plurality of distribution holes and be rotatably disposed in the injection flow path coupling portion, (i) when the flow path distributor is in a reference position, the plurality of distribution holes may be positioned so that all of the plurality of injection arm supply holes are opened, (ii) when the flow path distributor is rotated by a first angle from a reference position, the plurality of distribution holes may be positioned so that any one of the plurality of injection arm supply holes is opened.

The plurality of support ribs may be formed to correspond to at least one of the plurality of distribution holes of the flow path distributor in a state rotated by a first angle from a reference position.

In an embodiment of the present invention, the plurality of injection arms may include a first injection arm and a second injection arm.

In an embodiment of the present invention, the sump may include a sump body including a valve coupling portion having a washing water supply hole communicating with the washing pump and a guide groove for guiding the washing water introduced through the washing water supply hole to the plurality of injection arm supply holes, and a sump cover coupled to an upper side of the sump body and including the injection flow path coupling portion coupled to the valve coupling portion to form a switching valve chamber in which the flow path distributor is received.

In an embodiment of the present invention, the injection flow path coupling portion may have a first injection arm supply hole communicating with the first injection arm, and a second injection arm supply hole communicating with the second injection arm.

In an embodiment of the present invention, the flow path distributor may have a disc shape, and have a circular first distribution hole and a second distribution hole extended in a rotational direction of the flow path distributor, (i) when the flow path distributor is in a reference position, the first distribution hole may open the first injection arm supply hole, and the second distribution hole may open the second injection arm supply hole, and (ii) when the flow path distributor is rotated by the first angle from a reference position, the second distribution hole may open the second injection arm supply hole.

In an embodiment of the present invention, the plurality of support ribs may include a support rib having a shape corresponding to the second distribution hole of the flow path distributor in a state rotated by a first angle from a reference position. The plurality of support ribs may include a support rib having a shape corresponding to the first distribution hole of the flow path distributor in a state rotated by a first angle from a reference position.

In an embodiment of the present invention, when the flow path distributor is rotated by a second angle from a reference position, the second distribution hole may open the first injection arm supply hole. In this case, the plurality of support ribs may include a support rib having a shape corresponding to the second distribution hole of the flow path distributor in a state rotated by a second angle from a reference position. The plurality of support ribs may include a support rib having a shape corresponding to the first distribution hole of the flow path distributor in a state rotated by a second angle from a reference position.

In an embodiment of the present invention, the plurality of support ribs may include a first concentric circle rib separated by a first radius R1 based on a center of rotation of the flow path distributor. In this case, in the flow path distributor, an inner side end of the second distribution hole may be formed in a shape corresponding to a portion of the first concentric circle rib.

The plurality of support ribs may include a second concentric circle rib separated by a second radius R2 based on a center of rotation of the flow path distributor, and the second radius R2 may be greater than the first radius R1. In this case, in the flow path distributor, an outer side end of the second distribution hole may be formed in a shape corresponding to a portion of the second concentric circle rib.

In an embodiment of the present invention, the switching valve may include a drive motor for providing a driving force to rotate the flow path distributor, and a drive shaft for connecting the drive motor and the flow path distributor.

In another embodiment of the present invention, the plurality of injection arms may include a first injection arm, a second injection arm, and a third injection arm.

In another embodiment of the present invention, in the injection flow path coupling portion, a first injection arm supply hole communicating with the first injection arm, a second injection arm supply hole communicating with the second injection arm, and a third injection arm supply hole communicating with the third injection arm and adjacent to the second injection arm supply hole may be formed.

In another embodiment of the present invention, the flow path distributor may have a disc shape, and have a circular first distribution hole and a second distribution hole extended in a rotational direction of the flow path distributor, (i) when the flow path distributor is in a reference position, the first distribution hole may open the first injection arm supply hole, and the second distribution hole may open the second injection arm supply hole and the third injection arm supply hole, and (ii) when the flow path distributor is rotated by a first angle from a reference position, the second distribution hole may open the second injection arm supply hole.

Specific details of other embodiments are included in the detailed description and drawings.

Advantageous Effects

According to a dishwasher of the present invention, there are one or more of the following effects.

First, the flow of washing water in the space between a flow path distributor and a sump is limited by a support rib formed at a position corresponding to a distribution hole of the flow path distributor and thus there is an advantage that the flow path distributor vibrates due to a back pressure caused by washing water during an operation of the dishwasher and that durability thereof is prevented from being degraded.

Second, as the vibration of the flow path distributor is reduced, there is an advantage that a noise generated during an operation of the dishwasher is also reduced.

Third, as the generation of a back pressure by washing water during an operation of the dishwasher is reduced, there is an advantage that an injection mode can be switched smoothly, compared with the conventional case and that the time required to switch the injection mode can be reduced.

The effects of the present invention are not limited to the above-mentioned effects, and other effects that are not mentioned will become apparent to those skilled in the art from the description of the claims.

MODE FOR INVENTION

Figure 1:
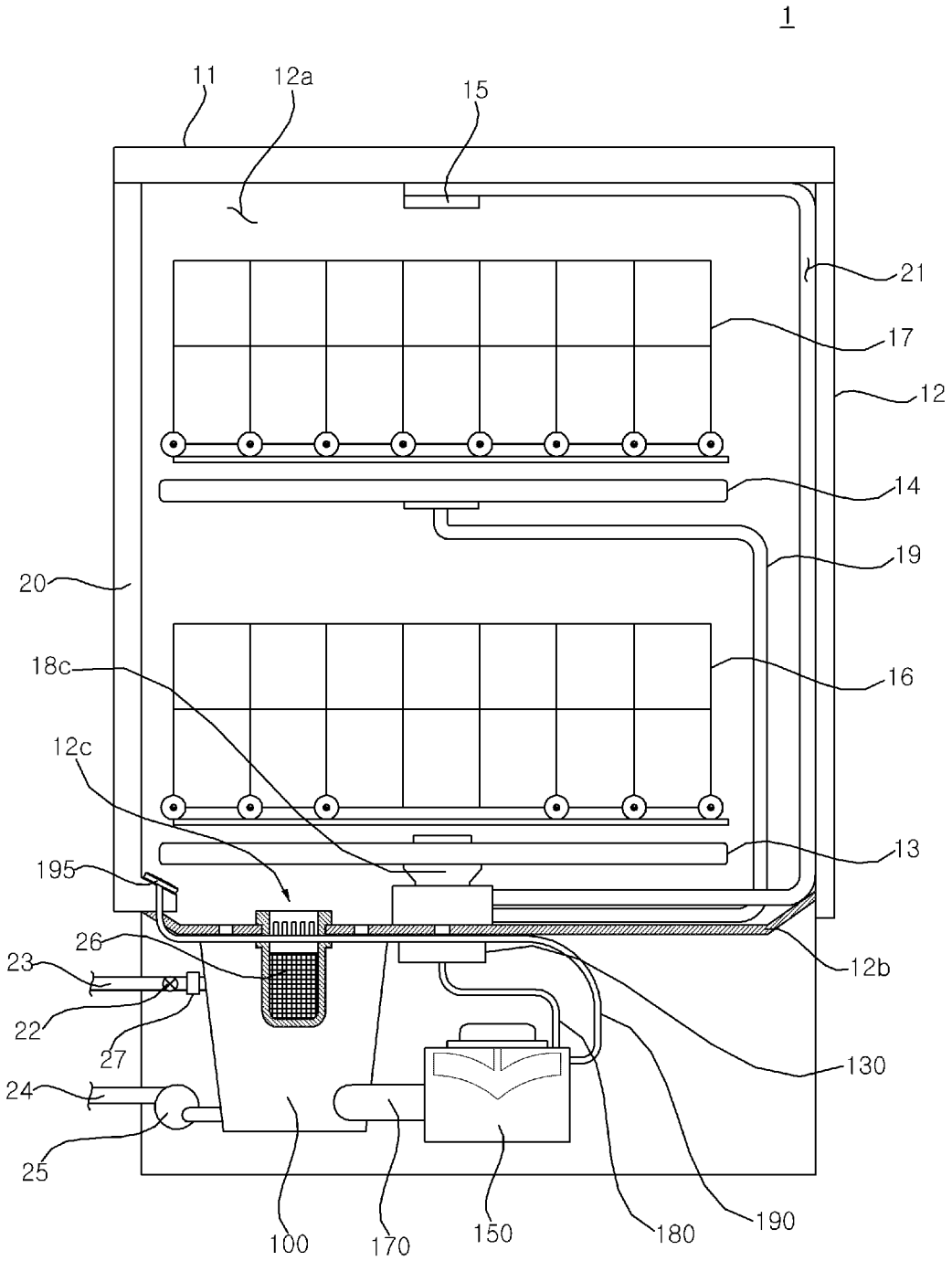
FIG. 1 is a schematic structural diagram of a dishwasher according to an embodiment of the present invention.

Advantages and features of the present invention, and methods for achieving them will be clarified with reference to embodiments described below in detail together with the accompanying drawings. However, the present invention is not limited to the embodiments disclosed below, but may be implemented in various different forms, and only these embodiments are provided to make the disclosure of the present invention complete, and to fully inform the scope of the invention to those skilled in the art to which the present invention pertains, and the present invention is only defined by the scope of the claims. The same reference numerals refer to the same components throughout the specification.

Hereinafter, the present invention will be described with reference to drawings for explaining a dishwasher according to embodiments of the present invention.

FIG. 1 is a schematic structural diagram of a dishwasher according to an embodiment of the present invention.

Figure 2:
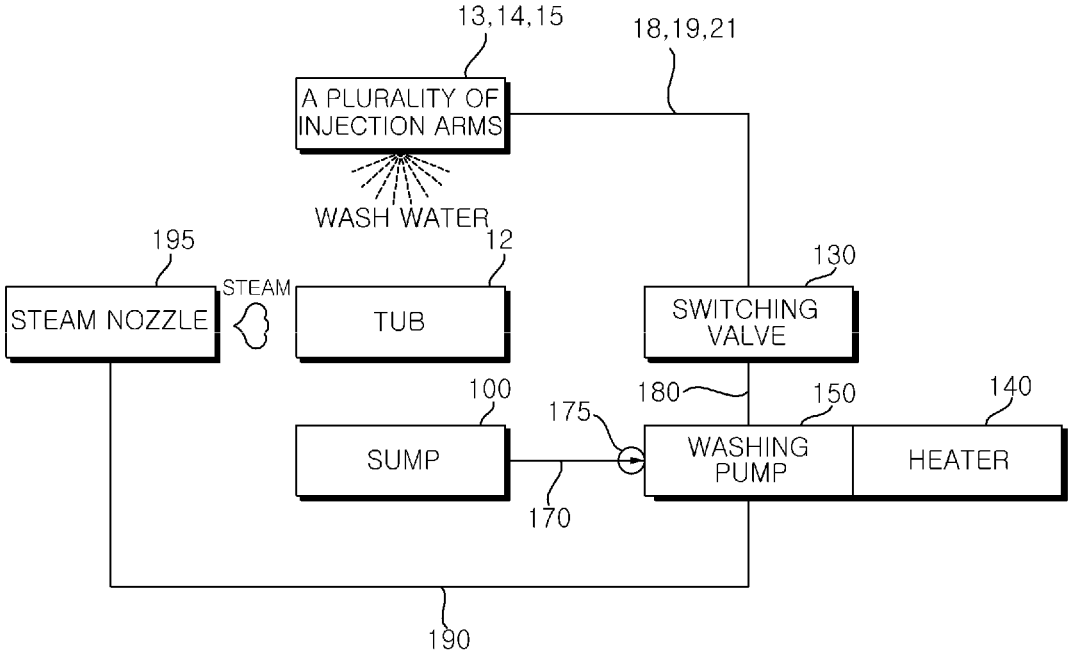
FIG. 2 is a block diagram of a dishwasher according to an embodiment of the present invention.

FIG. 2 is a block diagram of a dishwasher according to an embodiment of the present invention.

A dishwasher 1 according to an embodiment of the present invention includes a case 11 for forming an external shape, a tub 12 provided inside the case 11 to form a washing chamber 12*a* to receive a washing object, a door 20 provided at a front surface of the tub 12 to open and close the washing chamber 12*a*, a sump 100 disposed under the tub 12 to store washing water, a plurality of injection arms 13, 14, and 15 for injecting washing water into the tub 12, a washing pump 150 for supplying the washing water stored in the sump 100 to the plurality of injection arms 13, 14, and 15 and generating steam, a steam nozzle 195 provided in the door 20 to inject the steam generated in the washing pump 150 to the washing chamber 12*a*, a steam hose 190 for connecting the washing pump 150 and the steam nozzle 195, and a switching valve 130 disposed at the sump 100 to distribute the washing water to the plurality of injection arms 13, 14, and 15.

The case 11 may receive dishes, which are washing targets. The case 11 may receive entire components of the tub 12 and the dishwasher 1.

The tub 12 is formed in a hexahedron shape with an open front surface to form a washing chamber 12*a* therein. At the bottom 12*b* of the tub 12, a communication hole 12*c* for introducing washing water into the sump 100 is formed. The washing chamber 12*a* is provided with a plurality of racks 16 and 17 in which washing objects are received. The plurality of racks 16 and 17 include a lower rack 16 disposed at a lower portion of the washing chamber 12*a* and an upper rack 17 disposed at an upper portion thereof. The lower rack 16 and the upper rack 17 may be disposed to be spaced up and down and slide toward the front of the tub 12 to be pulled out.

The plurality of injection arms 13, 14 and 15 are disposed in a vertical direction. The plurality of injection arms 13, 14, and 15 include a low injection arm 13 disposed at the bottom to inject washing water from the lower side to the upper side toward the lower rack 16, an upper injection arm 14 disposed at the upper side of the low injection arm 13 to inject washing water from the lower side to the upper side toward the upper rack 17, and a top injection arm 15 disposed at the upper end of the washing chamber 12*a*, which is the upper side of the upper injection arm 14 to inject washing water from the upper side to the lower side.

The plurality of injection arms 13, 14, and 15 receive washing water from the washing pump 150 through a plurality of injection arm connecting flow paths 18, 19, and 21. The plurality of injection arm connecting flow paths 18, 19, and 21 include a low injection arm connection flow path 18 connected to the low injection arm 13, an upper injection arm connection flow path 19 connected to the upper injection arm 14, and a top injection arm connecting flow path 21 connected to the top injection arm 15.

The sump 100 is disposed under the bottom 12*b* of the tub 12 to collect washing water. The sump 100 is connected to a water supply flow path 23 for flowing washing water supplied from an external water source. The water supply flow path 23 is provided with a water supply valve 22 that controls the washing water supplied from an external water source. When the water supply valve 22 is opened, the washing water supplied from the external water source is introduced into the sump 100 through the water supply flow path 23. The water supply flow path 23 is provided with a flow meter 27 for measuring a flow rate of washing water flowed to the sump 100 therethrough.

The sump 100 is connected to a drainage flow path 24 for guiding the stored washing water to the outside of the dishwasher 1. The drainage flow path 24 is provided with a drainage pump 25 for draining the washing water inside the sump 100 through the drainage flow path 24. When the drainage pump 25 is driven, the washing water stored in the sump 100 is flowed outside the case 11 through the drainage flow path 24.

The sump 100 may include an injection flow path coupling portion 107 in which a plurality of injection arm supply holes communicating with a plurality of injection arms 13, 14, and 15 are respectively formed. The sump 100 will be described in detail later with reference to FIG. 3 and below.

The filter 26 is mounted in the communication hole 12*c* to filter dirt from the washing water moving from the tub 12 to the sump 100.

The washing pump 150 supplies washing water stored in the sump 100 to at least one of the plurality of injection arms 13, 14, and 15. The washing pump 150 is connected to the switching valve 130 and the washing water supply flow path 180. When the washing pump 150 is driven, the washing water stored in the sump 100 is introduced into the washing pump 150 through the water collecting flow path 170 and is then pushed to the switching valve 130 through the washing water supply flow path 180. The washing pump 150 may supply the washing water stored in the sump 100 to the plurality of injection arms 13, 14 and 15 through the injection flow path coupling portion 107.

The washing pump 150 may heat the washing water transferred to the washing water supply flow path 180. The washing pump 150 heats the washing water stored therein to generate steam. The washing pump 150 is connected to the steam hose 190. Steam generated in the washing pump 150 is supplied to the steam nozzle 195 through the steam hose 190.

The washing pump 150 is installed at one side of the sump 100. Because any one of pumps known in the art may be used, a detailed description of the washing pump 150 will be omitted here.

The heater 140 is coupled to the lower side of the washing pump 150 to heat washing water inside the washing pump 150. The heater 140 generates hot water by heating the washing water flowing in the washing pump 150 when the washing pump 150 operates. When the washing pump 150 is stopped, the heater 140 heats the washing water stored in the washing pump 150 to generate steam.

The hot water generated by the heater 140 is injected into the tub 12 through at least one of the plurality of injection arms 13, 14 and 15. The steam generated by the heater 140 flows along the steam hose 190 and is discharged into the tub 12 through the steam nozzle 195.

The steam nozzle 195 is provided at the bottom of the door 20 to inject steam into the washing chamber 12*a*. The steam injected from the steam nozzle 195 acts on the washing object received in the lower rack 16 and/or the upper rack 17.

The switching valve 130 selectively connects the sump 100 to at least one of the plurality of injection arms 13, 14, and 15. The switching valve 130 selectively supplies washing water pumped by the washing pump 150 to at least one of the low injection arm 13, the upper injection arm 14, and the top injection arm 15. The switching valve 130 selectively connects at least one of the plurality of injection arm connecting flow paths 18, 19, and 21 and the washing water supply flow path 180.

The switching valve 130 is disposed at the sump 100. The switching valve 130 may be disposed at the injection flow path coupling portion 107. The switching valve 130 may include a flow path distributor 131 for distributing washing water to at least one of the plurality of injection arms 13, 14, and 15. A detailed description of the switching valve 130 will be described later with reference to FIG. 10 or below.

The check valve 175 is disposed between the sump 100 and the washing pump 150 to be opened in a direction of the washing pump 150 from the sump 100. The check valve 175 is opened so that washing water flows from the sump 100 to the washing pump 150 and is closed so that steam does not flow from the washing pump 150 to the sump 100. The check valve 175 is opened by rotating the lower portion around the upper portion. The check valve 175 is disposed inside the water collecting flow path 170 or is connected between the water collecting flow path 170 and the washing pump 150 to open and close the water collecting flow path 170.

When the heater 140 generates steam, the check valve 175 is closed. The check valve 175 is opened when the washing pump 150 operates to flow washing water, and is closed when the washing pump 150 stops and washing water does not flow. The check valve 175 is opened by a flow pressure of the washing water of the washing pump 150. According to an embodiment, the check valve 175 may be a solenoid valve that is opened and closed by an electronic signal.

The check valve 175 is formed such that washing water flows from the washing pump 150 to the sump 100 even when the drainage pump 25 is closed during operation.

Figure 3:
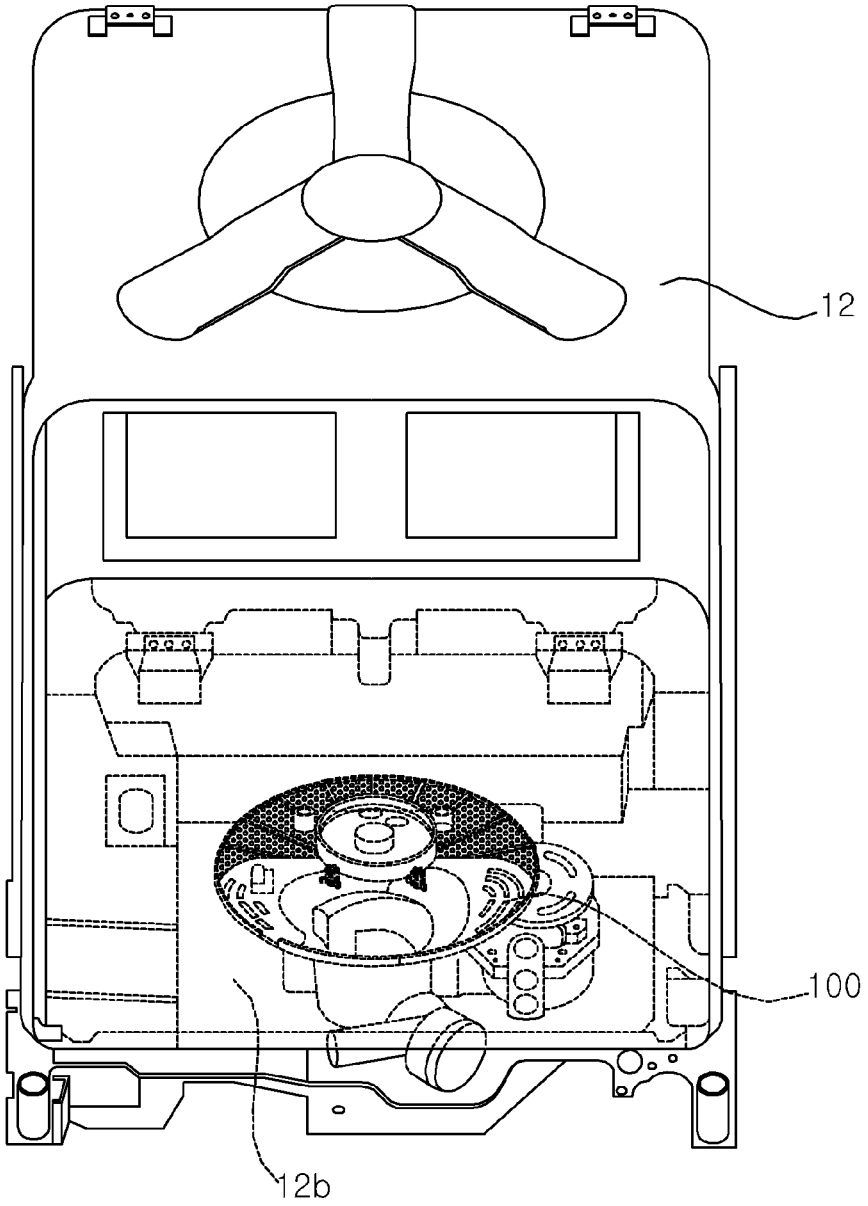
FIG. 3 is a diagram for explaining the disposition of a sump in a dishwasher according to an embodiment of the present invention.

FIG. 3 is a diagram for explaining the disposition of a sump in a dishwasher according to an embodiment of the present invention.

Figure 4:
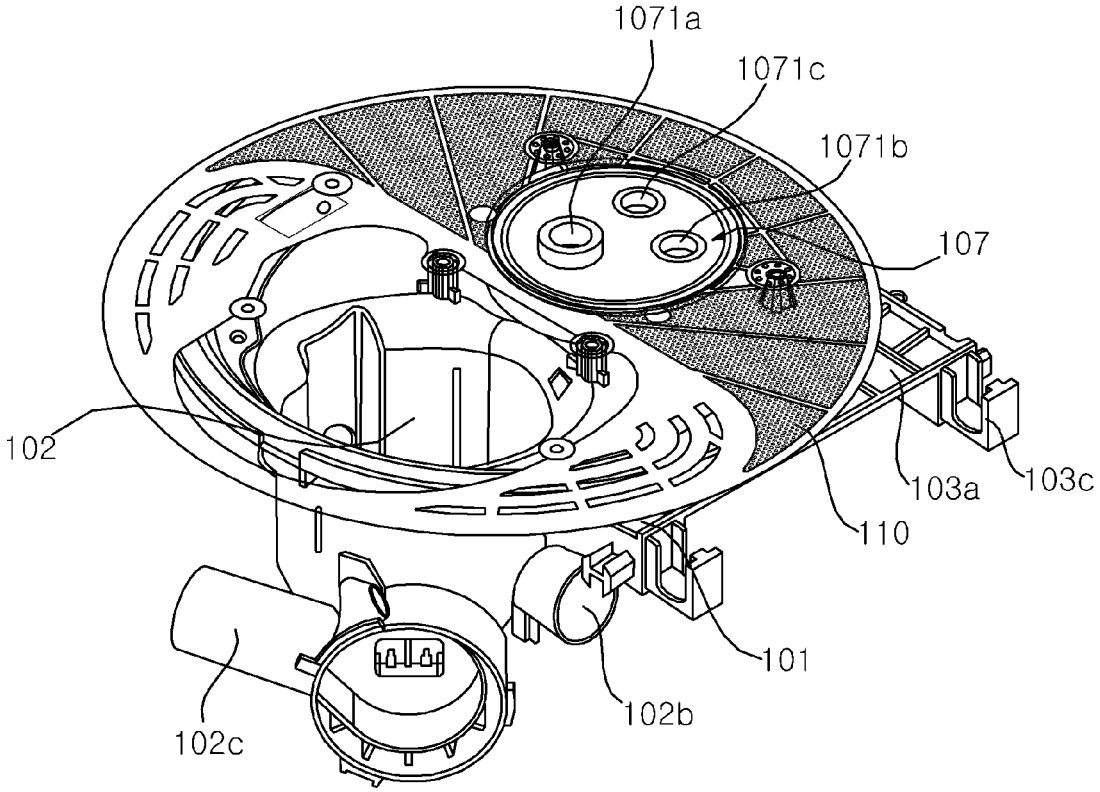
FIG. 4 is a perspective view of a sump of a dishwasher according to an embodiment of the present invention.

FIG. 4 is a perspective view of a sump of a dishwasher according to an embodiment of the present invention.

Figure 5:
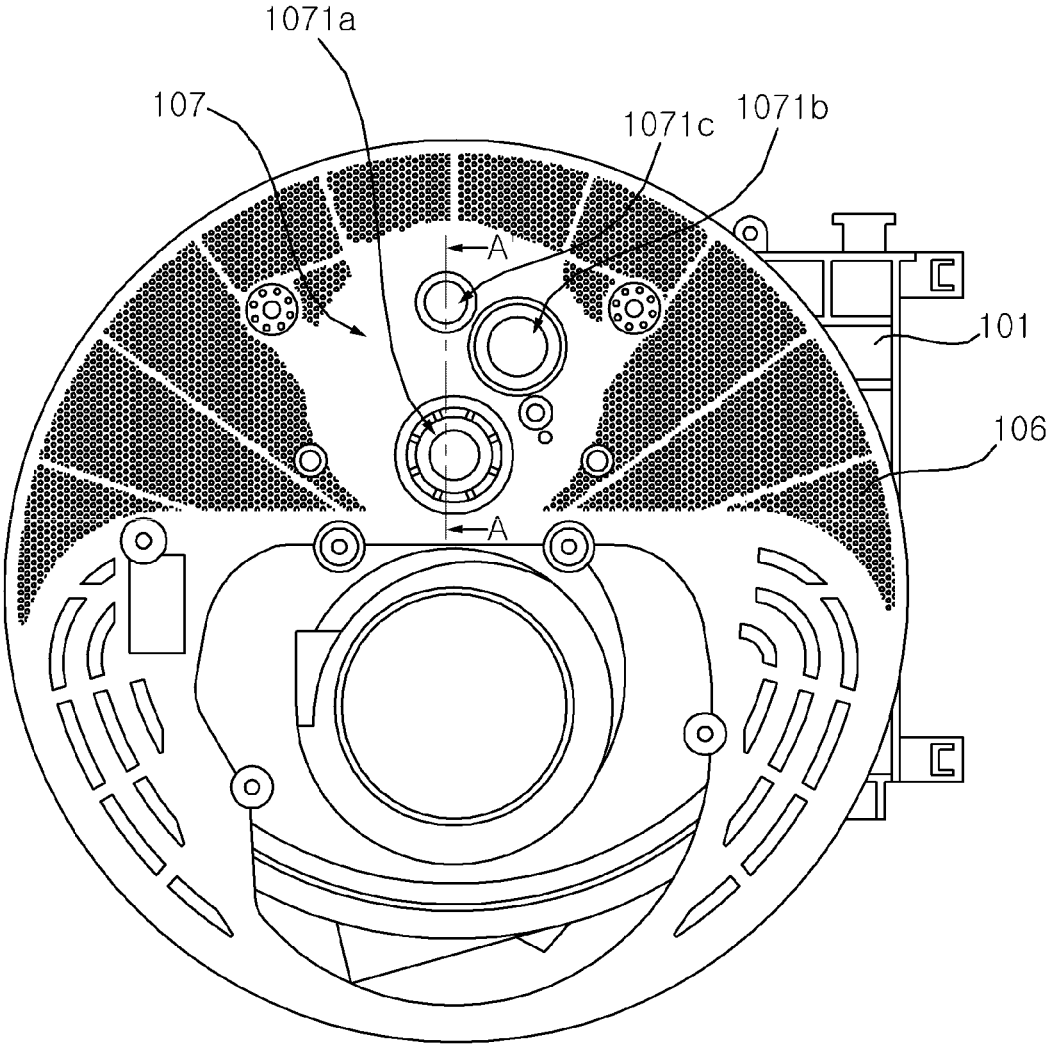
FIG. 5 is a plan view of a sump of a dishwasher according to an embodiment of the present invention.

FIG. 5 is a plan view of a sump of a dishwasher according to an embodiment of the present invention.

Figure 6:
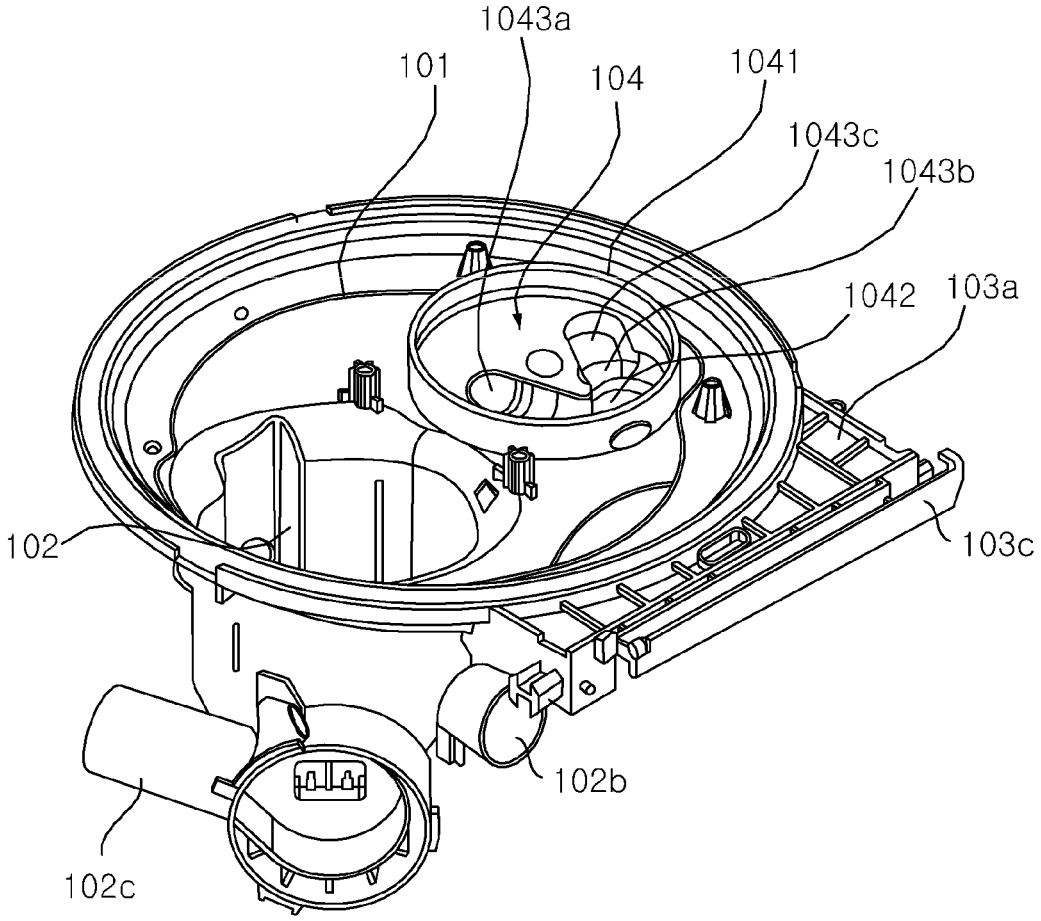
FIG. 6 is a perspective view of a sump body of a dishwasher according to an embodiment of the present invention.

FIG. 6 is a perspective view of a sump body of a dishwasher according to an embodiment of the present invention.

Figure 7:
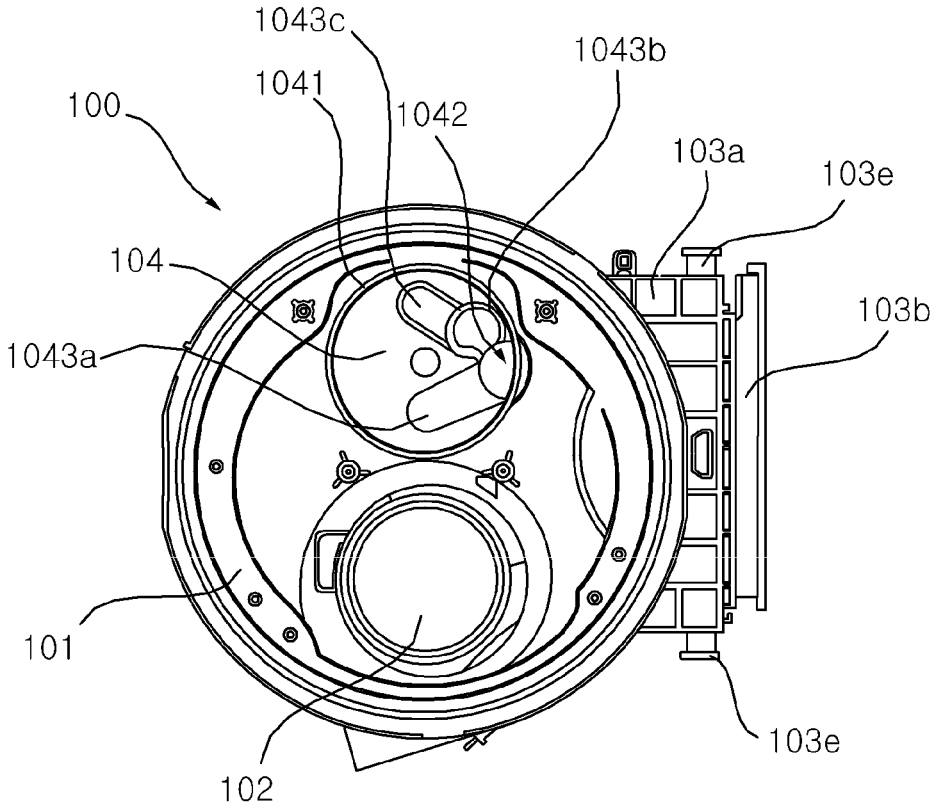
FIG. 7 is a plan view of a sump body of a dishwasher according to an embodiment of the present invention.

FIG. 7 is a plan view of a sump body of a dishwasher according to an embodiment of the present invention.

Figure 8:
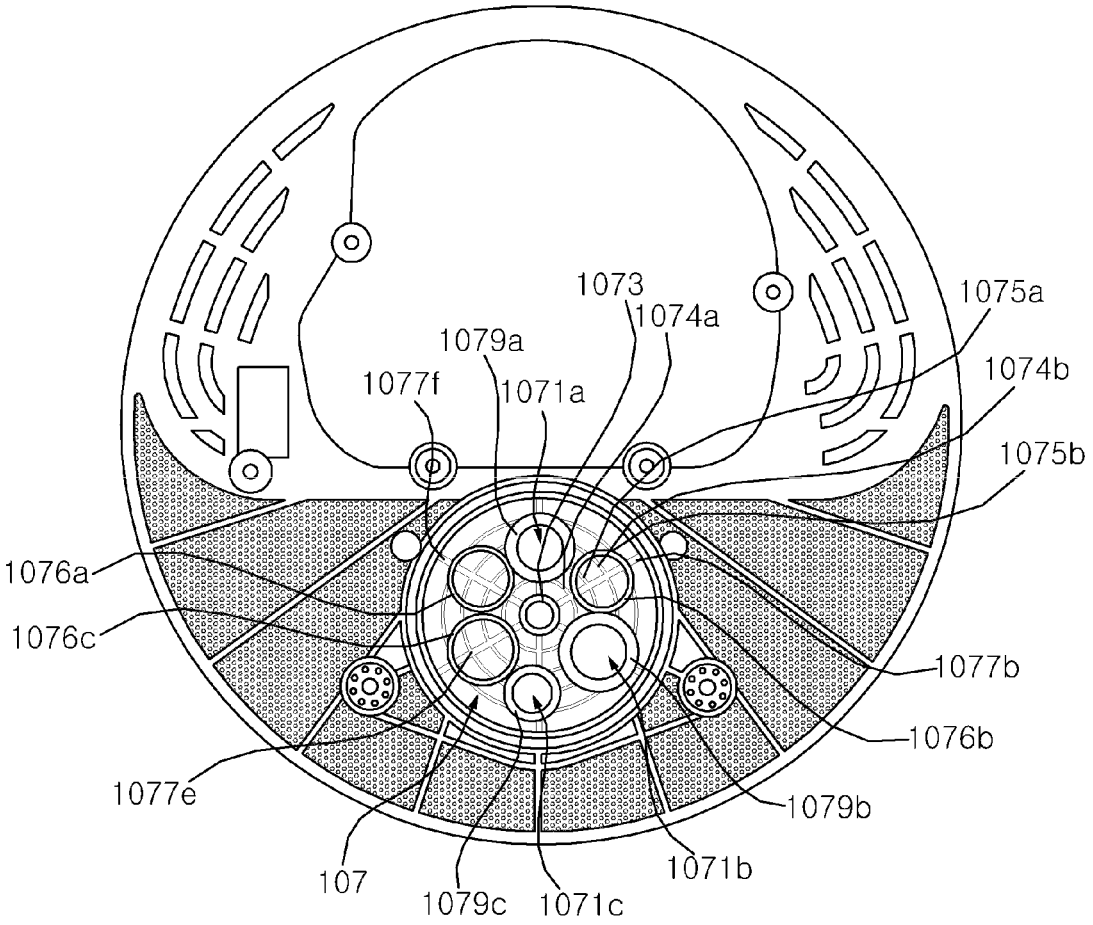
FIG. 8 is a rear view of a sump cover of a dishwasher according to an embodiment of the present invention.

FIG. 8 is a rear view of a sump cover of a dishwasher according to an embodiment of the present invention.

Figure 9:
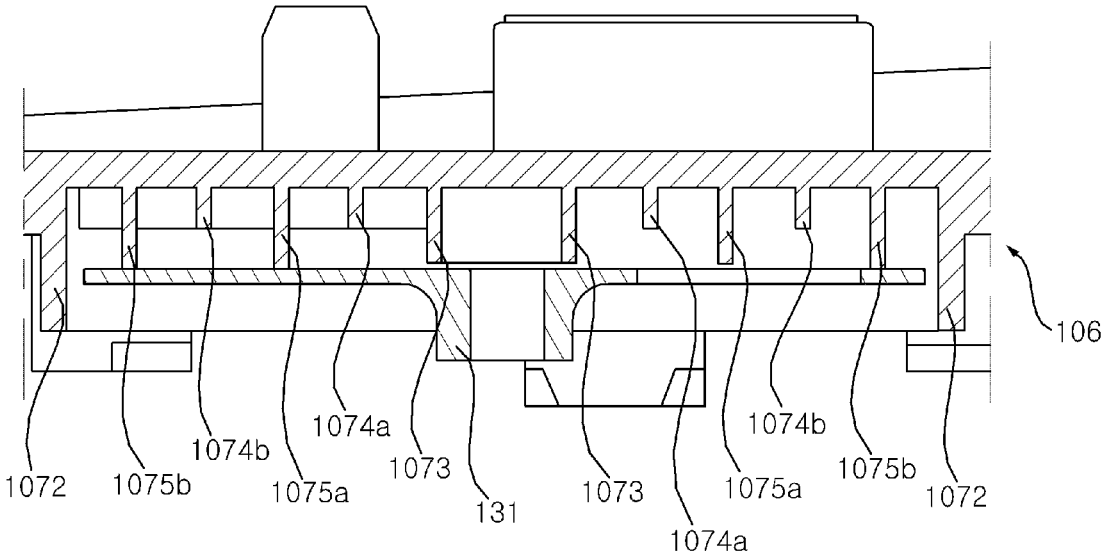
FIG. 9 is a partial cross-sectional view of a sump cover in a dishwasher according to an embodiment of the present invention.

FIG. 9 is a partial cross-sectional view of a sump cover in a dishwasher according to an embodiment of the present invention.

Referring to FIG. 3, the sump 100 according to an embodiment of the present invention is disposed under the tub 12. The sump 100 is disposed on the bottom 12*b* of the tub 12, and washing water inside the tub 12 may be collected into the sump 100 along the bottom 12*b*.

Referring to FIGS. 4 and 5, the sump 100 includes a sump body 101 coupled to the bottom 12*b* of the tub 12, a water collecting portion 102 for collecting washing water, a sump cover 106 coupled to the upper side of the sump body 101, a valve coupling portion 104 in which the switching valve 130 is disposed, an injection flow path coupling portion 107 coupled to the valve coupling portion 104 to form a switching valve chamber VC, a steam hose support portion 103 extended horizontally from the sump body 101 to support the steam hose 190, and a washing pump connection member 105 for connecting the steam hose support portion 103 and the washing pump 150.

The sump body 101 is disposed under the bottom 12*b* of the tub 12 to be coupled to the tub 12. The sump body 101 is formed in a substantially disc shape. The sump body 101 may have an inclined surface that guides washing water to the water collecting portion 102 at an upper surface thereof.

The water collecting portion 102 is formed in a cylindrical shape so that the collected washing water is stored. The water collecting portion 102 corresponds to the communication hole 12*c* of the tub 12 and is disposed under the communication hole 12*c*. At a side surface of the water collecting portion 102, a water supply pipe 102*a* in which a water supply flow path 23 is connected to introduce washing water supplied from an external water source into the water collection portion 102, a drainage portion 102*c* in which a drainage pump 25 is mounted and in which the drainage flow path 24 is connected to discharge washing water inside the water collecting portion 102, and a water collecting pipe 120*b* connected to the water collecting flow path 170 to discharge washing water inside the water collecting portion 102 are formed.

Referring to FIGS. 6 and 7, the sump 100 may be provided with a valve coupling portion 104 in which the switching valve 130 is disposed at the upper side of the sump body 101.

The valve coupling portion 104 may be provided at an upper side surface of the sump body 101 and be formed in a substantially circular shape. The valve coupling portion 104 may include an outer wall 1041 that forms an edge thereof and having a hollow cylindrical shape.

The outer wall 1041 of the valve coupling portion 104 may be provided in a cylindrical shape of a predetermined thickness.

An upper side surface of the valve coupling portion 104 may be provided higher than that of the sump body 101.

The valve coupling portion 104 may have a washing water supply hole 1042 communicating with the washing water supply flow path 180. The washing water supply hole 1042 may be formed by opening in a downward direction from the valve coupling portion 104. Through the washing water supply hole 1042, washing water may be introduced from the washing pump 150 to the valve coupling portion 104.

The valve coupling portion 104 may have a guide groove for guiding washing water introduced through the washing water supply hole 1042 to each of the plurality of injection arm supply holes.

The valve coupling portion 104 may include a low guide groove 1043*a* for guiding the washing water introduced through the washing water supply hole 1042 to the low injection arm supply hole 1071*a*. The valve coupling portion 104 may include an upper guide groove 1043*b* for guiding the washing water introduced through the washing water supply hole 1042 to the upper injection arm supply hole 1071*b*. The valve coupling portion 104 may include a top guide groove 1043*c* for guiding the washing water introduced through the washing water supply hole 1042 to the top injection arm supply hole 1071*c*.

Each of the low guide groove 1043*a*, the upper guide groove 1043*b*, and the top guide groove 1043*c* may be provided in a groove shape recessed downward from an upper side surface of the valve coupling portion 104. The low guide groove 1043*a* may have a groove shape extended from the washing water supply hole 1042 to a position in which the low injection arm supply hole 1071*a* is disposed. The upper guide groove 1043*b* may have a groove shape extended from the washing water supply hole 1042 to a position in which the upper injection arm supply hole 1071*b* is disposed. The top guide groove 1043*c* may have a groove shape extended from the upper guide groove 1043*b* to a position in which the top injection arm supply hole 1071*c* is disposed. The low guide groove 1043*a*, the upper guide groove 1043*b*, and the top guide groove 1043*c* formed as described above may guide washing water so that washing water introduced into one washing water supply hole 1042 is introduced into the plurality of injection arm supply holes 1071*a*, 1071*b*, and 1071*c*.

Thereby, the washing water introduced into the valve coupling portion 104 through the washing water supply hole 1042 may be guided to the low injection arm supply hole 1071*a* by the low guide groove 1043*a*. Alternatively, the washing water introduced into the valve coupling portion 104 through the washing water supply hole 1042 may be guided to the upper injection arm supply hole 1071*b* by the upper guide groove 1043*b*. Alternatively, the washing water introduced into the valve coupling portion 104 through the washing water supply hole 1042 may be guided for partial segment flow by the upper guide groove 1043*b* and then be guided for the remaining partial segment flow by the top guide groove 1043*c* to be introduced into the top injection arm supply hole 1071*c*.

Referring to FIGS. 5 and 8, the sump cover 106 may be coupled to the upper side of the sump body 101. The sump cover 106 may include a plurality of coupling portions for coupling with the sump body 101.

The sump cover 106 may have a plurality of through-holes so that washing water in the tub 12 may be introduced into the sump 100. The sump cover 106 may be provided with an injection flow path coupling portion 107 coupled with a plurality of injection arm connection flow paths 18, 19, and 21.

The injection flow path coupling portion 107 may constitute a part of the sump cover 106. The injection flow path coupling portion 107 may be coupled with the valve coupling portion 104 to form a switching valve chamber (VC of FIG. 10) in which a flow path distributor (131 of FIG. 10) to be described later is received.

The injection flow path coupling portion 107 may have a plurality of injection arm supply holes 1071*a*, 1071*b*, and 1071*c* penetrating the sump cover 106 up and down.

Referring to FIGS. 4 and 5, the plurality of injection arm supply holes 1071*a*, 1071*b*, and 1071*c* may be formed with different diameters. For example, a diameter of the hole may be large in order of the low injection arm supply hole 1071*a*, the upper injection arm supply hole 1071*b*, and the top injection arm supply hole 1071*c*. Thereby, washing water may be supplied to an injection arm positioned at the upper side at a predetermined pressure or higher.

The plurality of injection arm supply holes 1071*a*, 1071*b*, and 1071*c* may protrude upwards the sump cover 106 to form a coupling portion with the injection arm connection flow path. The plurality of injection arm supply holes 1071*a*, 1071*b*, and 1071*c* may be provided with hollow cylindrical protrusion coupling portions.

The upper injection arm supply hole 1071*b* may be disposed between the low injection arm supply hole 1071*a* and the top injection arm supply hole 1071*c*. The upper injection arm supply hole 1071*b* may be disposed between the top injection arm supply hole 1071*c* and the washing water supply hole 1042 in a state where the sump cover 106 and the sump body 101 are coupled. The upper injection arm supply hole 1071*b* may be formed closer to the top injection arm supply hole 1071*c* than the low injection arm supply hole 1071*a*.

Referring to FIG. 5, the low injection arm supply hole 1071*a* may be disposed at the side close to the water collecting portion 102 of the valve coupling portion 104. The top injection arm supply hole 1071*c* may be formed at a position facing the low injection arm supply hole 1071*a* based on the center of the valve coupling portion 104. The upper injection arm supply hole 1071*b* may be provided to form an angle of 30° to 60° from the top injection arm supply hole 1071*c* based on the center of the valve coupling portion 104.

Referring to FIGS. 5 and 8, the valve coupling portion 104 may be roughly divided into six equal parts. For example, the valve coupling portion 104 may include a first region in which a low injection arm supply hole 1071*a* is formed, a third region in which an upper injection arm supply hole 1071*b* is formed, and a fourth region in which a top injection arm supply hole 1071*c* is formed.

The plurality of injection arm supply holes 1071*a*, 1071*b*, and 1071*c* may have different hole sizes. For example, the size of the top injection arm supply hole 1071*c* is formed smaller than the low injection arm supply hole 1071*a* or the upper injection arm supply hole 1071*b*, and thus washing water pushed by the washing pump 150 may reach effectively the top injection arm 15.

The plurality of injection arm supply holes 1071*a*, 1071*b*, and 1071*c* may be connected to the plurality of injection arm connection flow paths 18, 19, and 21. The low injection arm supply hole 1071*a* may be connected to the low injection arm connection flow path 18. The upper injection arm supply hole 1071*b* may be connected to the upper injection arm connection flow path 19. The top injection arm supply hole 1071*c* may be connected to the top injection arm connection flow path 21.

Alternatively, in this embodiment, a hole corresponding to the low injection arm supply hole 1071*a* may be connected to the upper injection arm connection flow path 19 or the top injection arm connection flow path 21. In this case, the hole may be referred to as an upper injection arm supply hole or a top injection arm supply hole. Even in the case of the hole corresponding to the upper injection arm supply hole 1071*b* or the top injection arm supply hole, the hole may be connected to any one different from this embodiment among the plurality of injection arm connection flow paths 18, 19, and 21.

The plurality of injection arm supply holes 1071*a*, 1071*b*, and 1071*c* may be opened and closed by the flow path distributor 131. A detailed description of a method of opening and closing the plurality of injection arm supply holes 1071*a*, 1071*b*, and 1071*c* using the flow path distributor 131 will be described later with reference to FIG. 14.

The injection flow path coupling portion 107 may be provided with a switching valve 130 at the lower side. The injection flow path coupling portion 107 may be provided with an outer wall 1072 protruded downward in a hollow cylindrical shape. The outer wall 1072 of the injection flow path coupling portion 107 may form a switching valve chamber (VC of FIG. 9) in which a flow path distributor (131 of FIG. 9) of the switching valve 130 is received therein.

The injection flow path coupling portion 107 may be provided with a central rib 1073 protruded in a circular ring shape at a central portion thereof.

The central rib 1073 divides the innermost space among spaces between the flow path distributor 131 and the injection path coupling portion 107 to prevent the washing water from introducing into the center of the injection flow path coupling portion 107 or the center of rotation of the flow path distributor 131.

The injection flow path coupling portion 107 may include a plurality of reinforcing ribs 1074*a*, 1074*b*, 1077*a* to 1077*f* and a plurality of supporting ribs 1075*a*, 1075*b*, 1076*a*, 1076*b*, and 1076*c* protruded downward.

The plurality of reinforcing ribs 1074*a*, 1074*b*, and 1077*a* to 1077*f* may be protruded by a predetermined length from the lower side of the valve coupling portion 104. The plurality of reinforcing ribs 1074*a*, 1074*b*, and 1077*a* to 1077*f* may include protrusion lines extended from the central rib 1073 to the edge of the valve coupling portion 104. The plurality of reinforcing ribs 1074*a*, 1074*b*, and 1077*a* to 1077*f* may include a plurality of projection lines forming concentric circles from the center of the central rib 1073, which is the center of rotation of the flow path distributor 131.

The plurality of reinforcing ribs 1074*a*, 1074*b*, and 1077*a* to 1077*f* may include a first circular reinforcing rib 1074*a* at a distance separated by a first distance from the center of the valve coupling portion 104. The plurality of reinforcing ribs 1074*a*, 1074*b*, and 1077*a* to 1077*f* may include a second circular reinforcing rib 1074*b* at a distance separated by a second distance from the center of the valve coupling portion 104.

The plurality of reinforcing ribs 1074*a*, 1074*b*, and 1077*a* to 1077*f* may include a plurality of radial ribs 1077*a*, 1077*b*, 1077*c*, 1077*d*, 1077*e*, and 1077*f* extended radially from the center of the valve coupling portion 104. The plurality of radial ribs 1077*a*, 1077*b*, 1077*c*, 1077*d*, 1077*e*, and 1077*f* may be projection lines extended from the outer side of the central rib 1073 to the outer wall 1072.

Thereby, the plurality of reinforcing ribs 1074*a*, 1074*b*, and 1077*a* to 1077*f* may reinforce structural rigidity of the sump cover 106 in which the valve coupling portion 104 is formed to prevent the sump cover 106 from being deformed or damaged by an external force. For example, as the plurality of reinforcing ribs 1074*a*, 1074*b*, and 1077*a* to 1077*f* are formed, the sump cover 106 may be prevented from being deformed by a water pressure of the washing water.

The plurality of support ribs 1075*a*, 1075*b*, 1076*a*, 1076*b*, and 1076*c* may be protruded to a predetermined height, and thus ends of the plurality of support ribs 1075*a*, 1075*b*, 1076*a*, 1076*b*, and 1076*c* may form a virtual plane. The plurality of support ribs 1075*a*, 1075*b*, 1076*a*, 1076*b*, and 1076*c* may be protruded further downward than the plurality of reinforcing ribs 1074*a*, 1074*b*, and 1077*a* to 1077*f*, and be provided to be in contact with the flow path distributor 131.

When the flow path distributor 131 is forced upward by washing water, the plurality of support ribs 1075*a*, 1075*b*, 1076*a*, 1076*b*, and 1076*c* may support the flow path distributor 131 downward. Thereby, a contact area between the flow path distributor 131 and the valve coupling portion 104 is reduced and thus a friction generated when the flow path distributor 131 rotates may be reduced.

The plurality of support ribs 1075*a*, 1075*b*, 1076*a*, 1076*b*, and 1076*c* may equally perform a function in which the above-described plurality of reinforcing ribs 1074*a*, 1074*b*, and 1077*a* to 1077*f* reinforce structural rigidity of the sump cover 106. That is, the plurality of support ribs 1075*a*, 1075*b*, 1076*a*, 1076*b*, and 1076*c* may reinforce structural rigidity of the sump cover 106 while supporting the flow path distributor 131.

A detailed description of the plurality of support ribs 1075*a*, 1075*b*, 1076*a*, 1076*b*, and 1076*c* will be described later with reference to FIG. 14.

Figure 10:
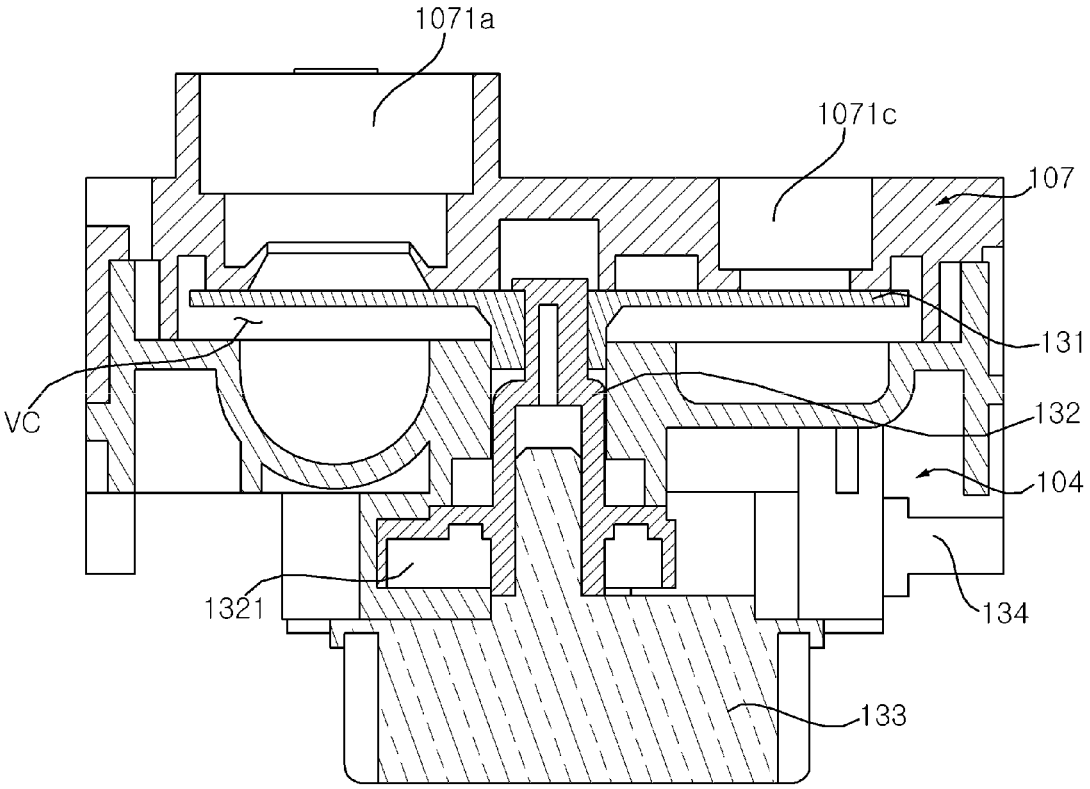
FIG. 10 is a partial cross-sectional view taken along line A-A' of FIG. 5.

FIG. 10 is a partial cross-sectional view taken along line A-A' of FIG. 5.

Figure 11:
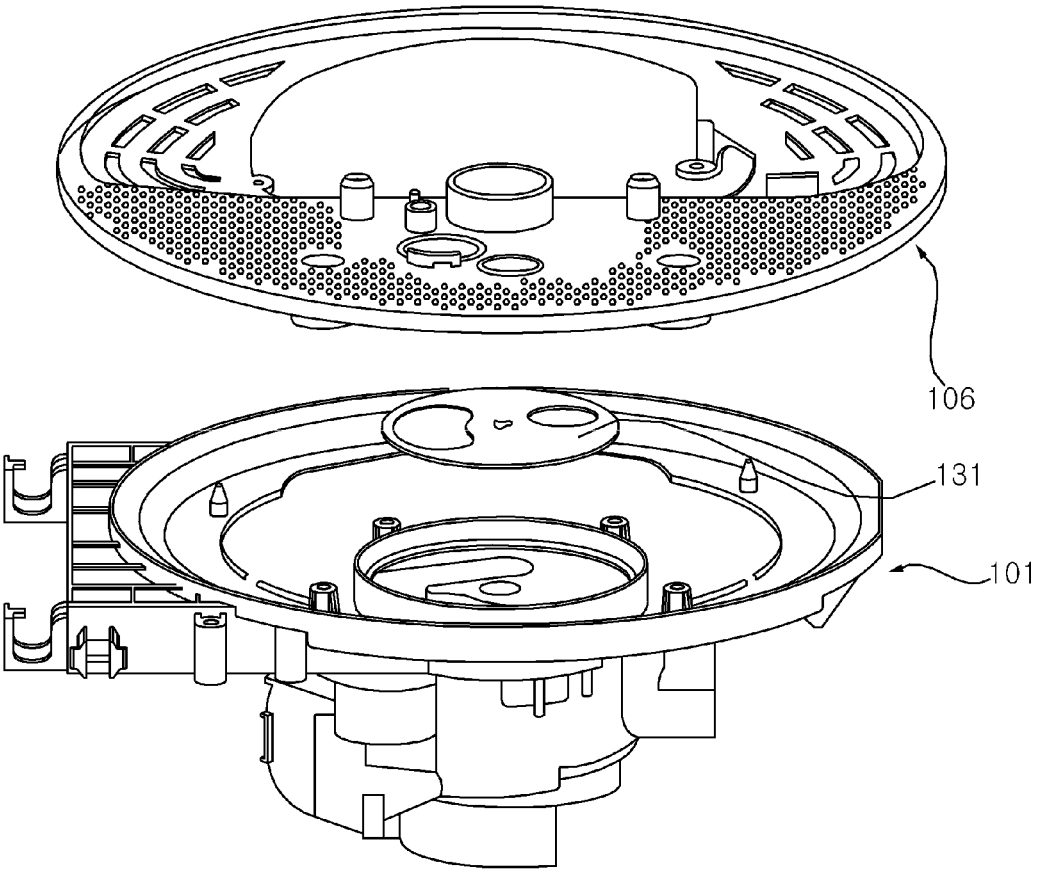
FIGS. 11 and 12 are exploded perspective views of a sump in a dishwasher according to an embodiment of the present invention.
Figure 12:
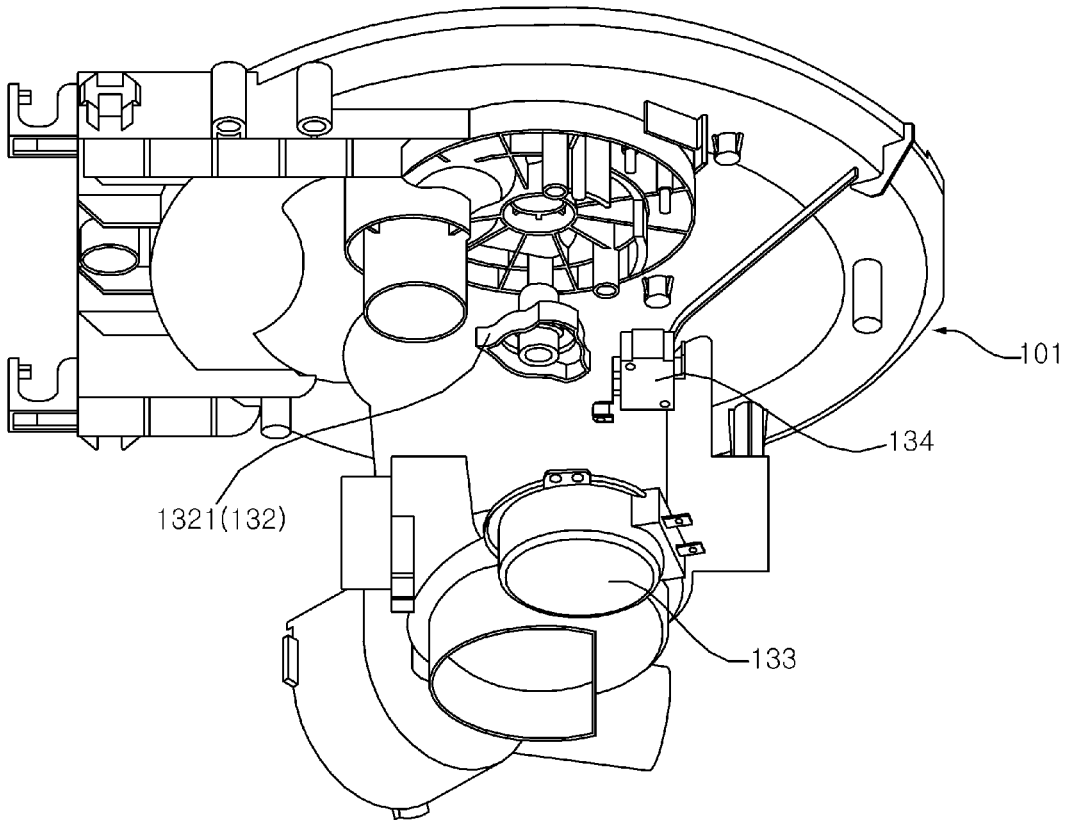

FIGS. 11 and 12 are exploded perspective views of a sump in a dishwasher according to an embodiment of the present invention.

Figure 13:
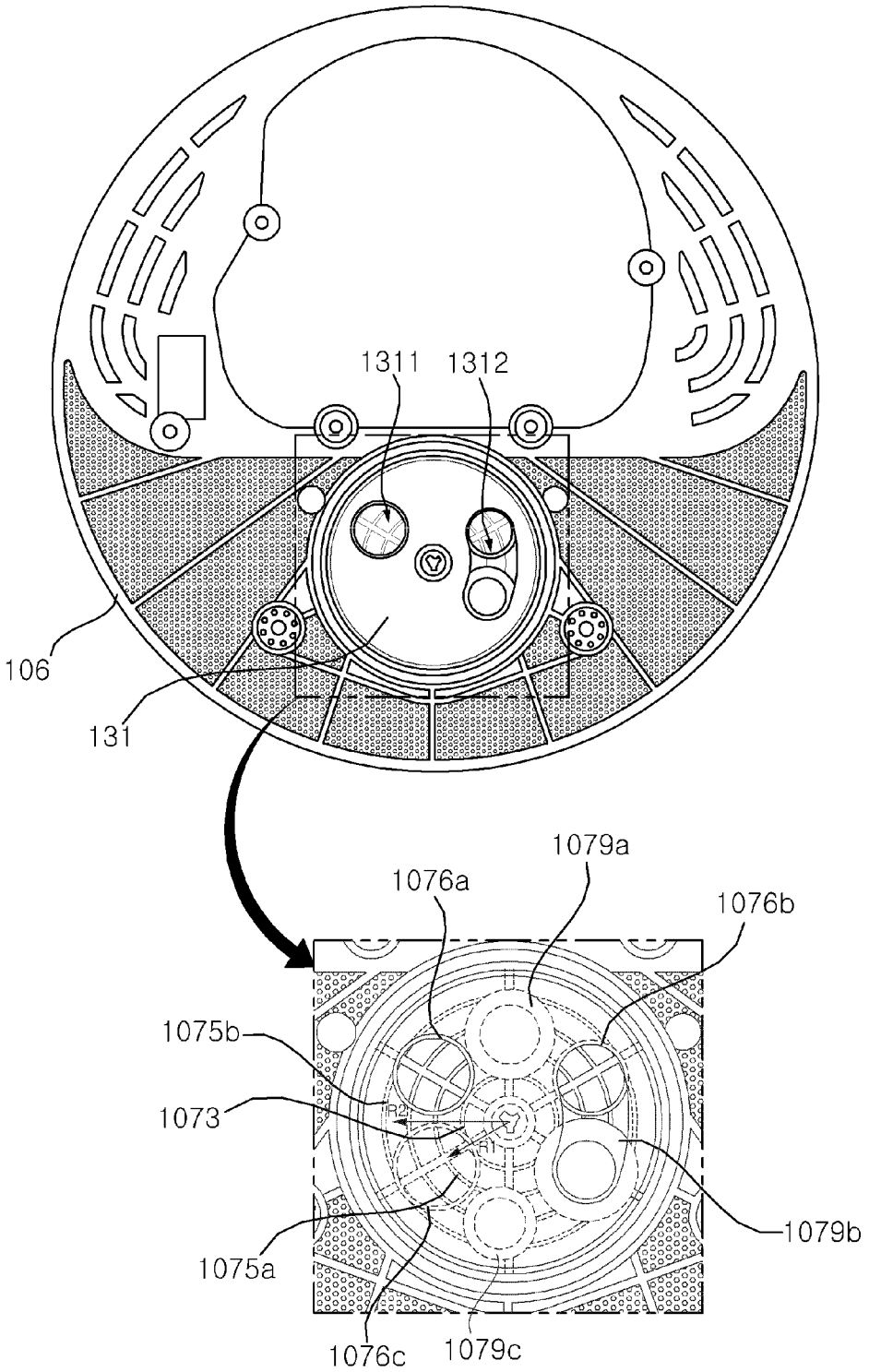
FIG. 13 is a diagram for explaining a switching valve in a dishwasher according to an embodiment of the present invention.

FIG. 13 is a diagram for explaining a switching valve in a dishwasher according to an embodiment of the present invention.

Referring to FIG. 10, the sump body 101 may be coupled to the sump cover 106 to form a switching valve chamber VC therebetween. The sump 100 may form a switching valve chamber VC in which the flow path distributor 131 is received by coupling of the injection flow path coupling portion 107 and the valve coupling portion 104.

The switching valve chamber VC may be formed in a cylindrical space to receive the flow path distributor 131 of the switching valve 130.

Referring to FIGS. 10 to 12, the switching valve 130 may be disposed at the valve coupling portion 104.

The switching valve 130 may include a flow path distributor 131 that opens and closes a plurality of injection arm supply holes 1071*a*, 1071*b*, and 1071*c*, a drive motor 133 for generating a driving force, a drive shaft 132 for rotating the flow path distributor 131 with a driving force generated by the drive motor 133, a rotating cam 1321 for rotating together with the flow path distributor 131 in a state coupled with the drive shaft 132, and a rotation sensor 134 contacting the rotating cam 1321 to detect a rotation angle of the flow path distributor 131. The switching valve 130 may be partially configured with a sump body 101 or a sump cover 106.

The switching valve 130 may be configured to include a portion of the valve coupling portion 104. For example, the switching valve 130 may be named as including a drive shaft through hole of the valve coupling portion 104.

The switching valve 130 may be configured to include a portion of the injection flow path coupling portion 107. For example, the switching valve 130 may be named as including a switching valve chamber VC formed by an outer side wall 1072 of the injection flow path coupling portion.

The flow path distributor 131 may have a disk shape as a whole.

The flow path distributor 131 may be disposed inside the switching valve chamber VC formed by coupling of the sump body 101 and the sump cover 106.

The flow path distributor 131 rotates by a predetermined angle according to a distribution mode and may transfer washing water to the plurality of injection arms 13, 14, and 15.

The distribution mode may include an entire injection mode for transferring washing water to all the injection arms, a low injection mode for transferring washing water only to the low injection arm 13, an upper injection mode for transferring washing water only to the upper injection arm 14, a top injection mode for transferring washing water only to the top injection arm 15, and a low top injection mode for transferring washing water to the low injection arm 13 and the top injection arm 15.

Referring to FIG. 13, the flow path distributor 131 may have a first distribution hole 1311 communicating with the low injection arm supply hole 1071*a* and a second distribution hole 1312 communicating with an upper injection arm supply hole 1071*b* and a top injection arm supply hole 1071*c* in the entire injection mode.

The first distribution hole 1311 may be formed in a circular shape to correspond to the low injection arm supply hole 1071*a*.

The second distribution hole 1312 may have a shape extended in a rotation direction of the flow path distributor 131.

The second distribution hole 1312 may have an elliptical shape curved outward based on the center of the flow path distributor 131. The second distribution hole 1312 may have a shape of a trajectory in which a circular hole rotates at a predetermined angle based on the center of rotation of the flow path distributor 131. The second distribution hole 1312 may have an open shape formed by combining two holes.

The second distribution hole 1312 may have an inner side end of a second distribution hole in a shape of a portion of a circle having a small radius among circles that simultaneously contact the two holes. That is, the second distribution hole 1312 may have an inner side end of the second distribution hole 1312 so as to contact a portion of the central rib 1073 of the injection flow path coupling portion 107.

The second distribution hole 1312 may have an outer side end of the second distribution hole in a shape of a portion of a circle having a large radius among circles that simultaneously contact the two holes. That is, the outer side end of the second distribution hole 1312 may be formed so that the second distribution hole 1312 contacts a portion of the second circular reinforcement rib 1074*b* of the injection flow path coupling portion 107.

The drive motor 133 may be provided as a step motor to control the number of revolutions. The drive motor 133 may be connected to and controlled by a control unit.

The drive shaft 132 may penetrate the through hole of the sump body 101 to be coupled to the flow path distributor 131. The drive shaft 132 may have one end coupled with the drive motor 133 and the other end coupled with the flow path distributor 131.

The drive shaft 132 is integrally provided with the rotating cam 1321 so that the drive shaft 132 and the rotating cam 1321 may rotate together when the flow path distributor 131 rotates.

The rotating cam 1321 is provided in a polygonal column shape as a whole, as shown in FIG. 12, and thus the detection end of the rotating sensor 134 may be moved as the rotating cam 1321 rotates.

The rotation sensor 134 may include a detection end contacting the rotation cam 1321 to detect whether the rotation cam 1321 has rotated to a predetermined position. For example, the rotation sensor 134 is provided with a switch for detecting on-off, and when the rotation cam starts a rotation to press the switch, the rotation sensor 134 may provide a stop signal to the drive motor 133. Alternatively, the rotation sensor 134 may be provided to be able to detect a horizontal movement distance of the detection end, and in the first injection mode, when the detection end is moved by a first distance, the drive motor 133 stops, and in the second injection mode, when the detection end is moved by a second distance, the rotation sensor 134 may provide a signal so that the drive motor 133 stops. Alternatively, a separate control unit is provided to receive a detection signal from the rotation sensor 134 to be configured to control the drive motor.

Figure 14:
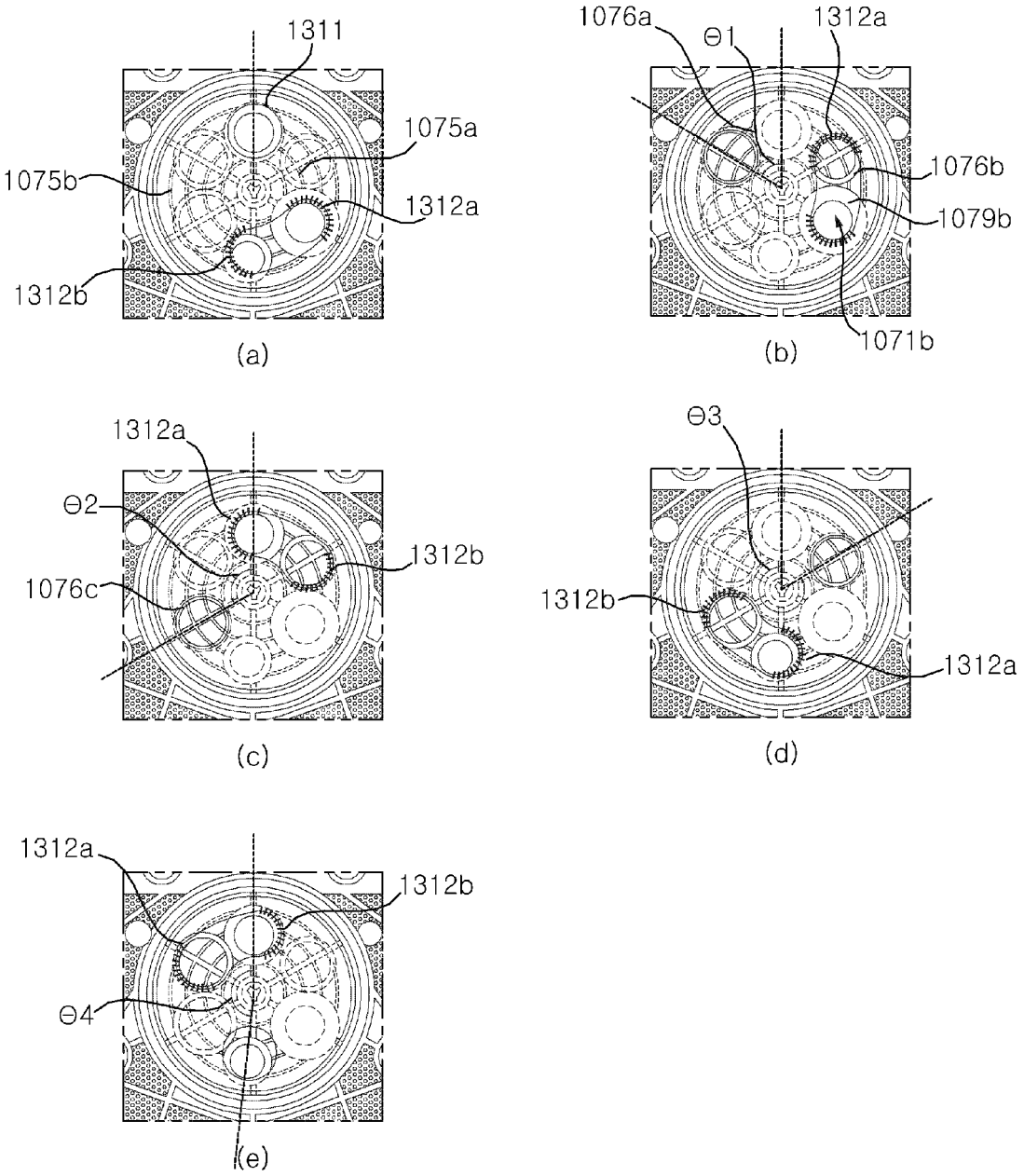
FIG. 14 is a diagram for explaining a switching valve in a dishwasher according to an embodiment of the present invention.

FIG. 14 is a diagram for explaining a switching valve in a dishwasher according to an embodiment of the present invention.

Referring to FIG. 14, a position of the flow path distributor 131 in the entire injection mode may be defined as a reference position. This is for convenience of description, and unlike this, a position of the flow path distributor 131 in another injection mode such as a low injection mode or an upper injection mode may be set as a reference position.

The entire injection mode may be defined to an injection mode in which the low injection arm supply hole 1071*a*, the upper injection arm supply hole 1071*b*, and the top injection arm supply hole 1071*c* are opened. In the entire injection mode, the flow path distributor 131 may be in a state positioned at a reference position.

The flow path distributor 131 may form a diameter of the first distribution hole 1311 to be larger than that of the low injection arm supply hole 1071*a*. In the flow path distributor 131, the second distribution hole 1312 may be formed so as not to interfere with washing water passing through the upper injection arm supply hole 1071*b* and the top injection arm supply hole 1071*c*.

A plurality of support ribs 1075*a*, 1075*b*, 1076*a*, 1076*b*, and 1076*c* of the valve coupling portion 104 may include a plurality of supply hole ribs 1079*a*, 1079*b*, and 1079*c* formed to correspond to the plurality of injection arm supply holes 1071*a*, 1071*b*, and 1071*c*.

The plurality of support ribs 1075*a*, 1075*b*, 1076*a*, 1076*b*, and 1076*c* may include a low supply hole rib 1079*a* formed to enclose the low injection arm supply hole 1071*a*, an upper supply hole rib 1079*b* formed to enclose the upper injection arm supply hole 1071*b*, and a top supply hole rib 1079*c* formed to enclose the top injection arm supply hole 1071*c*.

The plurality of supply hole ribs 1079*a*, 1079*b*, and 1079*c* may have a flat protruding end so as to form a contact surface with the flow path distributor 131. Thereby, the flow path distributor 131 may be in close contact with the injection arm supply hole and thus the washing water may flow smoothly to the plurality of injection arm connecting flow paths 18, 19, and 21.

Referring to FIG. 14(*a*), when the flow path distributor 131 is in a reference position (entire injection mode), a plurality of distribution holes 1311 and 1312 may be positioned so that all of the plurality of injection arm supply holes 1071*a*, 1071*b*, and 1071*c* are opened.

The flow path distributor 131 may be supported downward by the first concentric circle rib 1075*a* and the second concentric circle rib 1075*b*. The flow path distributor 131 may be pressurized by the washing pump 150 to be supported upward by washing water introduced into the valve chamber and to be supported downward by a plurality of support ribs 1075*a*, 1075*b*, 1076*a*, 1076*b*, and 1076*c*.

When the flow path distributor 131 is in the reference position, the size of the first distribution hole 1311 and the second distribution hole 1312 may be formed not to interfere with the washing water introduced into the plurality of injection arm supply holes 1071*a*, 1071*b*, and 1071*c*. When the flow path distributor 131 is in a reference position, the first distribution hole 1311 may open the low injection arm supply hole 1071*a*, and the second distribution hole 1312 may open the upper injection arm supply hole 1071*b* and the top injection arm supply hole 1071*c*.

When the flow path distributor 131 is in a reference position, the first distribution hole 1311 may be positioned on the low supply hole rib 1079*a* to open the low injection arm supply hole 1071*a*.

When the flow path distributor 131 is in a reference position, the second distribution hole 1312 may be positioned in a state over the upper supply hole rib 1079*b* and the top supply hole ribs 1079*c* to open the upper injection arm supply hole 1071*b* and the top injection arm supply hole 1071*c*.

In this case, one side end 1312*a* of the second distribution hole may be positioned on the upper supply hole rib 1079*b*, and the other side end 1312*b* of the second distribution hole may be positioned on the top supply hole rib 1079*c*.

In the upper injection mode, the low injection arm supply hole 1071*a* and the top injection arm supply hole 1071*c* may be closed, and the upper injection arm supply hole 1071*b* may be defined to an opened injection mode. In the upper injection mode, the flow path distributor 131 may be rotated by a first angle 81 from the reference position.

In other words, when the flow path distributor 131 is rotated by a first angle 81 from the reference position, the plurality of distribution holes 1311 and 1312 may be positioned so that the upper injection arm supply hole 1071*b* of the plurality of injection arm supply holes is opened.

The second distribution hole 1312 may be divided into one side end 1312*a* of a second distribution hole close to the first distribution hole 1311 and the other side end 1312*b* of a second distribution hole far from the first distribution hole 1311. In the upper injection mode, one side end 1312*a* of the second distribution hole may contact the upper injection arm supply hole 1071*b*. One side end 1312*a* of the second distribution hole may be positioned on the upper supply hole rib 1079*b*.

When the flow path distributor 131 is rotated by the first angle 81 from the reference position, the second distribution hole 1312 may open the upper injection arm supply hole 1071*b*.

A plurality of support ribs 1075*a*, 1075*b*, 1076*a*, 1076*b*, and 1076*c* may be formed to correspond to at least one of the plurality of distribution holes 1311 and 1312 of the flow path distributor 131 in a state rotated by a first angle 81 from the reference position. The plurality of support ribs 1075*a*, 1075*b*, 1076*a*, 1076*b*, and 1076*c* may include a second corresponding rib 1076*b*, which is a shape corresponding to the second distribution hole 1312 of the flow path distributor 131 in a state rotated by the first angle 81 from the reference position.

The plurality of support ribs 1075*a*, 1075*b*, 1076*a*, 1076*b*, and 1076*c* may include a second corresponding rib 1076*b*, which is a shape corresponding to one side end 1312*a* of the second distribution hole in a state in which the flow path distributor 131 is rotated by the first angle 81 from the reference position. Here, one side end 1312*a* of the second distribution hole may be an opposite end of the other side end 1312*b* of the second distribution hole positioned on the upper supply hole rib 1079*b* in the upper injection mode.

The second corresponding rib 1076*b* is provided in a circular shape and thus in the upper injection mode, a semicircle of the second corresponding rib 1076*b* may contact the second distribution hole 1312.

The plurality of support ribs 1075*a*, 1075*b*, 1076*a*, 1076*b*, and 1076*c* may include a plurality of concentric circle ribs 1075*a* and 1075*b* disposed on a concentric circle from the center of the valve coupling portion 104 (or the center of rotation of the flow path distributor 131).

The plurality of support ribs 1075*a*, 1075*b*, 1076*a*, 1076*b*, and 1076*c*, the low supply hole rib 1079*a*, the first corresponding rib 1076*a*, the upper supply hole rib 1079*b*, the top supply hole rib 1079*c*, the three corresponding rib 1076*c*, and the second corresponding rib 1076*b* may be disposed in a circular shape as a whole.

The plurality of concentric circle ribs 1075*a* and 1075*b* may include a first concentric circle rib 1075*a* having a radius R1 and a second concentric rib 1075*b* having a radius R2 from the center of the valve coupling portion 104 (or the center of rotation of the flow path distributor 131). In this case, R1 may be smaller than R2.

A portion of the second concentric circle rib 1075*b* may be formed in a shape corresponding to the outer side end of the second distribution hole.

The second distribution hole 1312 may contact the central rib 1073. Even if a position of the flow path distributor 131 changes (or, even if the flow path distributor 131 rotates), a portion of the second distribution hole 1312 may be positioned on the central rib 1073.

The second distribution hole 1312 may contact the second concentric circle rib 1075*b*. Even if the position of the flow path distributor 131 changes (or, even if the flow path distributor 131 rotates), a portion of the second distribution hole 1312 may be positioned on the second concentric circle rib 1075*b*.

In a state in which the flow path distributor 131 is rotated by the first angle 81 from the reference position, the plurality of support ribs 1075*a*, 1075*b*, 1076*a*, 1076*b*, and 1076*c* may include a first corresponding rib 1076*a*, which is a shape corresponding to the first distribution hole 1311. The first corresponding rib 1076*a* may contact the first distribution hole 1311 in the upper injection mode.

The plurality of support ribs 1075*a*, 1075*b*, 1076*a*, 1076*b*, and 1076*c* may include a plurality of concentric circle ribs 1075*a* and 1075*b* disposed on a concentric circle from the center of the valve coupling portion 104 (or the center of rotation of the flow path distributor 131).

The plurality of support ribs 1075*a*, 1075*b*, 1076*a*, 1076*b*, and 1076*c*, the low supply hole rib 1079*a*, the first corresponding rib 1076*a*, the upper supply hole rib 1079*b*, the top supply hole rib 1079*c*, the third corresponding rib 1076*c*, and the second corresponding rib 1076*b* may be disposed in a circular shape as a whole. Referring to FIG. 14, the plurality of support ribs 1075*a*, 1075*b*, 1076*a*, 1076*b*, and 1076*c*, the low supply hole rib 1079*a*, the second corresponding rib 1076*b*, the upper supply hole rib 1079*b*, the top supply hole rib 1079*c*, the third corresponding rib 1076*c*, and the first corresponding rib 1076*a* may be disposed clockwise in order.

The plurality of concentric circle ribs 1075*a* and 1075*b* may include a first concentric circle rib 1075*a* having a radius R1 and a second concentric circle rib 1075*b* having a radius R2 from the center of the valve coupling portion 104 (or the center of rotation of the flow path distributor 131). In this case, R1 may be smaller than R2.

The first distribution hole 1311 may be circumscribed with the central rib 1073. Even if the position of the flow path distributor 131 changes (or, even if the flow path distributor 131 rotates), a portion of the first distribution hole 1311 may be positioned on the first concentric circle rib 1075*a*.

Thereby, the washing water introduced into a space between the flow path distributor 131 and the injection flow path coupling portion 107 through the first distribution hole 1311 may be prevented from being introduced to the center of the injection flow path coupling portion 107 or the center of rotation of the flow path distributor 131.

The first distribution hole 1311 may be inscribed with the second concentric circle rib 1075*b*. Even if the position of the flow path distributor 131 changes (or, even if the flow path distributor 131 rotates), a portion of the first distribution hole 1311 may be positioned on the first concentric circle rib 1075*a*.

The second concentric circle rib 1075*b* provided in this way may divide the outermost space among spaces between the flow path distributor 131 and the injection flow path coupling portion 107 to reduce the flow of washing water in the space between the flow path distributor 131 and the injection flow path coupling portion 107.

The flow path distributor 131 in a state rotated by the first angle 61 from the reference position may be formed so that one side end 1312*a* of the second distribution hole corresponds to the second corresponding rib 1076*b*, the other side end 1312*b* of the second distribution hole corresponds to the upper supply hole rib 1079*b*, an inner side end of the second distribution hole corresponds to the central rib 1073, and an outer side end of the second distribution hole corresponds to the second concentric circle rib 1075*b*.

That is, the flow path distributor 131 in a state rotated by the first angle 81 from the reference position may be formed to correspond to a plurality of support ribs and thus washing water introduced into the injection flow path coupling portion 107 of the sump cover 106 and the flow path distributor 131 through the second distribution hole 1312 may be limited to flow only in a region corresponding to the second distribution hole 1312.

Thereby, when washing water pressurized from the washing pump 150 is transferred to the upper injection arm 14 through the switching valve 130, the washing water is introduced into a space between the flow path distributor 131 and the sump cover 106 and thus a pressure that pushes the flow path distributor 131 in an opposite direction of the main flow of the washing water is reduced, and a vibration of the flow path distributor 131 may be thus reduced.

The low injection mode may be defined as an injection mode in which the low injection arm supply hole 1071*a* is opened and in which the upper injection arm supply hole 1071*b* and the top injection arm supply hole 1071*c* are closed. In the low injection mode, the flow path distributor 131 may be rotated by a second angle 82 from the reference position.

When the flow path distributor 131 is rotated by the second angle 82 from the reference position (in the low injection mode), the second distribution hole 1312 may open the low injection arm supply hole 1071*a*. The plurality of support ribs 1075*a*, 1075*b*, 1076*a*, 1076*b*, and 1076*c* may include a support rib of a shape corresponding to the second distribution hole 1312 of the flow path distributor 131 in a state rotated by the second angle 82 from the reference position.

In the low injection mode, one side end 1312*a* of the second distribution hole may contact the low supply hole rib 1079*a*. One side end 1312*a* of the second distribution hole may be positioned on the row supply hole rib 1079*a*.

In a state in which the flow path distributor 131 is rotated by a second angle 82 from the reference position, the plurality of support ribs 1075*a*, 1075*b*, 1076*a*, 1076*b*, and 1076*c* may include a second corresponding rib 1076*b*, which is a shape corresponding to the other side end 1312*b* of the second distribution hole. The second corresponding rib 1076*b* may be provided in a circular shape. That is, the second corresponding rib 1076*b* may be provided in a circular shape, and thus in an upper injection mode, a semicircle of the second corresponding rib 1076*b* may contact one side end 1312*a* of the second distribution hole, and in a low injection mode, the remaining semicircle of the second corresponding rib 1076*b* may contact the other side end 1312*b* of the second distribution hole.

In a state in which the flow path distributor 131 is rotated by a second angle 82 from the reference position, the plurality of support ribs 1075*a*, 1075*b*, 1076*a*, 1076*b*, and 1076*c* may include a third corresponding rib 1076*c*, which is a shape corresponding to the first distribution hole 1311. The third corresponding rib 1076*c* may contact the first distribution hole 1311 in the low injection mode.

The third corresponding rib 1076*c* may have a circular ring shape.

The top injection mode may be defined as an injection mode in which the low injection arm supply hole 1071*a* and the upper injection arm supply hole 1071*b* are closed and in which the top injection arm supply hole 1071*c* is opened. In the top injection mode, the flow path distributor 131 may be rotated by a third angle 83 from the reference position.

In the top injection mode, one side end 1312*a* of the second distribution hole may contact the top supply hole rib 1079*c*. One side end 1312*a* of the second distribution hole may be positioned on the top supply hole rib 1079*c*.

In the top injection mode, the first distribution hole 1311 may contact the first corresponding rib 1076*a*. The first distribution hole 1311 may be positioned on the first corresponding rib 1076*a* in the top injection mode.

The low top injection mode may be defined as an injection mode in which the low injection arm supply hole 1071*a* and the top injection arm supply hole 1071*c* are opened and in which the upper injection arm supply hole 1071*b* is closed. In the low injection mode, the flow path distributor 131 may be rotated by a fourth angle 84 from the reference position.

In the low top injection mode, one side end 1312*a* of the second distribution hole may contact the first corresponding rib 1076*a*. One side end 1312*a* of the second distribution hole may be positioned on the first corresponding rib 1076*a*.

In the low top injection mode, the other side end 1312*b* of the second distribution hole may contact the low supply hole rib 1079*a*. The other side end 1312*b* of the second distribution hole may be positioned on the row supply hole rib 1079*a*.

In the low top injection mode, the first distribution hole 1311 may contact the top supply hole rib 1079*c*. The first distribution hole 1311 may be positioned on the top supply hole rib 1079*c* in the low top injection mode.

The dishwasher configured in this way may perform a plurality of injecting modes.

As shown in FIG. 14, the injection flow path coupling portion 107 is roughly divided into six parts, and each thereof may be divided into areas of a fan shape, and a low injection arm supply hole is formed at a 12 o'clock position, an upper injection arm supply hole is formed at a 4 o'clock position, and a top injection arm supply hole is formed at a 6 o'clock position. Further, the flow path distributor has a first distribution hole corresponding to the low injection arm supply hole, and a second distribution hole corresponding to the upper injection arm supply hole and the top injection arm supply hole.

Thereby, as the flow path distributor rotates by a predetermined angle based on the reference position, any one of a plurality of injection modes may be performed in which any one of the plurality of injection arm supply holes is opened or any two of the plurality of injection modes are opened.

Further, in the dishwasher configured as described above, while the washing pump is operated and water is supplied to the injection arm, noise and vibration caused by shaking of the flow path distributor may be reduced.

As shown in FIG. 14, the injection flow path coupling portion is provided with a plurality of support ribs and thus a space between the flow path distributor and the injection flow path coupling portion may be divided into a plurality of spaces.

Thereby, when the washing pump 150 operates and washing water is transferred to the plurality of injection arms 13, 14, and 15 through the switching valve 130, even if the washing water passing through the switching valve 130 penetrates into the space between the flow path distributor 131 and the valve coupling portion 104, the flow of the washing water is limited, and thus a pressure in which the washing water pushes the flow path distributor 131 in an opposite direction of the main flow of the washing water may be reduced.

As a result, the dishwasher configured in this way can suppress a vibration of the flow path distributor to prevent damage and fatigue damage of the flow path distributor or the sump (sump body or sump cover) and to reduce noise generated by a vibration.

Although the preferred embodiments of the present invention have been illustrated and described above, the present invention is not limited to the specific embodiments described above, and various modifications can be made by those skilled in the art to which the present invention pertains without departing from the gist of the present invention claimed in the claims and, and these modifications should not be individually understood from the technical idea or prospect of the present invention.

[Description of symbols]

| | |
|---|---|
| 1: dishwasher | 11: case |
| 12: tub | 16, 17: rack |
| 20: door | 100: sump |
| 130: switching valve | 23: water supply flow path |
| 24: drainage flow path | 26: filter |
| 13, 14, 15: a plurality of injection arms | |
| 18, 19, 21: a plurality of injection arm connection flow path | |
| 140: heater | 150: washing pump |
| 170: water collecting flow path | 175: check valve |
| 180: washing water supply flow path | 190: steam hose |
| 195: steam nozzle | |

What is claimed is:

1. A dishwasher, comprising:

a case configured to receive a washing object;

a plurality of injection arms configured to inject washing water into the case;

a sump disposed at a lower side of the case and configured to store the washing water, the sump comprising an injection flow path coupling portion that defines a plurality of injection arm supply holes configured to communicate with the plurality of injection arms, respectively;

a washing pump configured to supply the washing water stored in the sump to the plurality of injection arms through the injection flow path coupling portion; and a switching valve disposed in the injection flow path coupling portion, the switching valve comprising a flow path distributor configured to distribute the washing water to at least one of the plurality of injection arms, wherein the flow path distributor has a plurality of distribution holes and is rotatably disposed in the injection flow path coupling portion, wherein the plurality of distribution holes are configured to:

based on the flow path distributor being located at a reference position, be positioned to open all of the plurality of injection arm supply holes, and based on the flow path distributor being rotated by a first angle from the reference position, be positioned to open any one of the plurality of injection arm supply holes, wherein the injection flow path coupling portion comprises a plurality of support ribs protruded toward the flow path distributor, the plurality of support ribs comprising a support rib corresponding to at least one of the plurality of distribution holes of the flow path distributor in a state rotated by the first angle from the reference position, and wherein the sump further comprises:

a sump body comprising a valve coupling portion that defines a washing water supply hole configured to communicate with the washing pump and a guide groove configured to guide washing water introduced through the washing water supply hole to the plurality of injection arm supply holes, and a sump cover that is coupled to an upper side of the sump body and that includes the injection flow path coupling portion, the injection flow path coupling portion being coupled to the valve coupling portion and defining a switching valve chamber that receives the flow path distributor.

2. The dishwasher of claim 1, wherein the plurality of injection arms comprise a first injection arm and a second injection arm, and wherein the injection flow path coupling portion has a first injection arm supply hole configured to communicate with the first injection arm, and a second injection arm supply hole configured to communicate with the second injection arm.

3. The dishwasher of claim 2, wherein the flow path distributor has a disc shape, and has a first distribution hole that has a circular shape and a second distribution hole that extends in a rotational direction of the flow path distributor, wherein the first distribution hole and the second distribution hole are configured to, based on the flow path distributor being located at the reference position, open the first injection arm supply hole and the second injection arm supply hole, respectively, and wherein the second distribution hole is configured to, based on the flow path distributor being rotated by the first angle from the reference position, open the second injection arm supply hole.

4. The dishwasher of claim 3, wherein the plurality of support ribs comprise a support rib having a shape corresponding to the second distribution hole of the flow path distributor in the state rotated by the first angle from the reference position.

5. The dishwasher of claim 4, wherein the plurality of support ribs comprise a support rib having a shape corresponding to the first distribution hole of the flow path distributor in the state rotated by the first angle from the reference position.

6. The dishwasher of claim 3, wherein the second distribution hole is configured to open the first injection arm supply hole based on the flow path distributor being rotated by a second angle from the reference position, and wherein the plurality of support ribs comprise a support rib having a shape corresponding to the second distribution hole of the flow path distributor in a state rotated by the second angle from the reference position.

7. The dishwasher of claim 6, wherein the plurality of support ribs comprise a support rib having a shape corresponding to the first distribution hole of the flow path distributor in the state rotated by the second angle from the reference position.

8. The dishwasher of claim 3, wherein the plurality of support ribs comprise a first concentric circle rib separated by a first radius R1 based on a center of rotation of the flow path distributor.

9. The dishwasher of claim 8, wherein the plurality of support ribs comprise a second concentric circle rib separated by a second radius R2 based on the center of rotation of the flow path distributor, and the second radius R2 is greater than the first radius R1, and wherein, in the flow path distributor, an outer side end of the second distribution hole is has a shape corresponding to a portion of the second concentric circle rib.

10. The dishwasher of claim 2, wherein the plurality of injection arms comprise a third injection arm, and wherein the injection flow path coupling portion has a third injection arm supply hole communicating with the third injection arm and adjacent to the second injection arm supply hole.

11. The dishwasher of claim 10, wherein the flow path distributor has a disc shape, and has a first distribution hole that has a circular shape and a second distribution hole that extends in a rotational direction of the flow path distributor, wherein the first distribution hole is configured to, based on the flow path distributor being at the reference position, open the first injection arm supply hole, and the second distribution hole is configured to open the second injection arm supply hole and the third injection arm supply hole based on the flow path distributor being located at the reference position, and wherein the second distribution hole is configured to, based on the flow path distributor being rotated by the first angle from the reference position, open the second injection arm supply hole.

12. The dishwasher of claim 1, wherein the switching valve comprises:

a drive motor configured to provide driving force to rotate the flow path distributor, and a drive shaft that connects the drive motor and the flow path distributor.

13. The dishwasher of claim 1, wherein the injection flow path coupling portion further comprises:

a central rib that protrudes from a central portion of the injection flow path coupling portion and that has a circular ring shape about the central portion.

14. A dishwasher, comprising:

a case configured to receive a washing object;

a plurality of injection arms configured to inject washing water into the case;

a sump disposed at a lower side of the case and configured to store the washing water, the sump comprising an injection flow path coupling portion that defines a plurality of injection arm supply holes in fluid communication with the plurality of injection arms, respectively;

a washing pump configured to supply the washing water stored in the sump to the plurality of injection arms through the injection flow path coupling portion; and a switching valve disposed in the injection flow path coupling portion, the switching valve comprising a flow path distributor configured to distribute the washing water to at least one of the plurality of injection arms, wherein the flow path distributor has a plurality of distribution holes and is rotatably disposed in the injection flow path coupling portion, wherein the plurality of distribution holes are configured to:

based on the flow path distributor being located at a reference position, be positioned to open all of the plurality of injection arm supply holes, and based on the flow path distributor being rotated by a first angle from the reference position, be positioned to open any one of the plurality of injection arm supply holes, and wherein the injection flow path coupling portion comprises:

a plurality of support ribs protruded toward the flow path distributor, the plurality of support ribs comprising a support rib corresponding to at least one of the plurality of distribution holes of the flow path distributor in a state rotated by the first angle from the reference position, and a central rib that protrudes from a central portion of the injection flow path coupling portion and that has a circular ring shape about the central portion.

15. The dishwasher of claim 14, wherein the sump further comprises:

a sump body comprising a valve coupling portion that defines a washing water supply hole configured to communicate with the washing pump and a guide groove configured to guide washing water introduced through the washing water supply hole to the plurality of injection arm supply holes; and a sump cover that is coupled to an upper side of the sump body and that includes the injection flow path coupling portion, the injection flow path coupling portion being coupled to the valve coupling portion and defining a switching valve chamber that receives the flow path distributor.

16. The dishwasher of claim 15, wherein the plurality of injection arms comprise a first injection arm and a second injection arm, and wherein the injection flow path coupling portion has:

a first injection arm supply hole configured to communicate with the first injection arm, and a second injection arm supply hole configured to communicate with the second injection arm.

* * * * *